US011063362B2

(12) United States Patent
Posthuma et al.

(10) Patent No.: US 11,063,362 B2
(45) Date of Patent: Jul. 13, 2021

(54) PORTABLE FLAT-PANEL SATELLITE ANTENNA

(71) Applicant: Kymeta Corporation, Redmond, WA (US)

(72) Inventors: Ben Posthuma, Kirkland, WA (US); Adam Nonis, Redmond, WA (US); David Lamme, Covington, WA (US)

(73) Assignee: KYMETA CORPORATION, Redmond, WA (US)

( * ) Notice: Subject to any disclaimer, the term of this patent is extended or adjusted under 35 U.S.C. 154(b) by 94 days.

(21) Appl. No.: 16/295,204

(22) Filed: Mar. 7, 2019

(65) Prior Publication Data

US 2019/0280387 A1 Sep. 12, 2019

Related U.S. Application Data

(60) Provisional application No. 62/641,120, filed on Mar. 9, 2018.

(51) Int. Cl.

| | |
|---|---|
| ***H01Q 1/27*** | (2006.01) |
| ***H01Q 9/04*** | (2006.01) |
| ***H01Q 21/00*** | (2006.01) |
| ***H01Q 3/34*** | (2006.01) |
| ***H01Q 21/06*** | (2006.01) |
| ***H01Q 1/42*** | (2006.01) |

(52) U.S. Cl.

CPC ..... *H01Q 9/0442* (2013.01); *H01Q 1/27* (2013.01); *H01Q 1/42* (2013.01); *H01Q 3/34* (2013.01); *H01Q 21/0056* (2013.01); *H01Q 21/065* (2013.01)

(58) Field of Classification Search

CPC ..... H01Q 1/27; H01Q 1/28; H01Q 1/288; H01Q 1/42; H01Q 1/427; H01Q 1/428; H01Q 3/34; H01Q 9/0442; H01Q 21/0056; H01Q 21/065

See application file for complete search history.

(56) References Cited

U.S. PATENT DOCUMENTS

| | | | | |
|---|---|---|---|---|
| 2014/0263844 | A1* | 9/2014 | Cook, Jr. | H02S 30/20 244/164 |
| 2017/0054205 | A1* | 2/2017 | Feldman | H01Q 21/26 |
| 2017/0187101 | A1 | 6/2017 | Freeman et al. | |
| 2017/0346176 | A1* | 11/2017 | Linn | H01Q 21/064 |

OTHER PUBLICATIONS

Extended European Search Report for Application No. 19161828.9 dated Jun. 7, 2019, 8 pages.

* cited by examiner

*Primary Examiner* — Jimmy T Vu

(74) *Attorney, Agent, or Firm* — Womble Bond Dickinson (US) LLP

(57) ABSTRACT

A portable flat panel antenna system and method for using the same are disclosed. In one embodiment, the portable satellite antenna apparatus comprises a flat panel antenna and a container to house the antenna, the container having at least one radio-frequency (RF) transparent material through which the antenna is operable to transmit and receive satellite communications.

15 Claims, 11 Drawing Sheets

PORTABLE FLAT-PANEL SATELLITE ANTENNA

PRIORITY

The present patent application claims priority to and incorporates by reference the corresponding provisional patent application Ser. No. 62/641,120, titled, "BPORTABLE FLAT-PANEL SATELLITE ANTENNA," filed on Mar. 9, 2018.

FIELD OF THE INVENTION

Embodiments of the present invention relate to the field of antennas for wireless communication; more particularly, embodiments of the present invention relate to a portable container for satellite antenna that includes a radio-frequency (RF) transparent lid.

BACKGROUND OF THE INVENTION

Rapid establishment of communications is required for military, public safety, humanitarian assistance and disaster response. Traditional communication solutions are isolated and non-integrated architectures not designed to work together. Furthermore, Very Small Aperture Terminals (VSATs) typically require SATCOM technicians to deploy with, install, and commission the terminals. Many deployable VSATs are not capable of on-the-move operations and must be manually or mechanically pointed (by hand or electrical actuators) at the satellite. These requirements make traditional satellite communications a non-optimal process when on-the-move and rapid satellite acquisition is mandatory for operations as is the case in disaster response, first responder and defense applications.

SUMMARY OF THE INVENTION

A portable flat panel antenna system and method for using the same are disclosed. In one embodiment, the portable satellite antenna apparatus comprises a flat panel antenna and a container to house the antenna, the container having at least one radio-frequency (RF) transparent material through which the antenna is operable to transmit and receive satellite communications.

BRIEF DESCRIPTION OF THE DRAWINGS

The present invention will be understood more fully from the detailed description given below and from the accompanying drawings of various embodiments of the invention, which, however, should not be taken to limit the invention to the specific embodiments, but are for explanation and understanding only.

DETAILED DESCRIPTION

In the following description, numerous details are set forth to provide a more thorough explanation of the present invention. It will be apparent, however, to one skilled in the art, that the present invention may be practiced without these specific details. In other instances, well-known structures and devices are shown in block diagram form, rather than in detail, in order to avoid obscuring the present invention.

Embodiments of a portable flat panel antenna and method for using the same are disclosed. In one embodiment, the flat panel antenna is contained in and transported in a ruggedized rapidly deployable and self-contained container. In one embodiment, the container comprises a network system capable of establishing and bridging multiple terrestrial and on-orbit networks in fixed and on-the-move environments.

Figure 1:
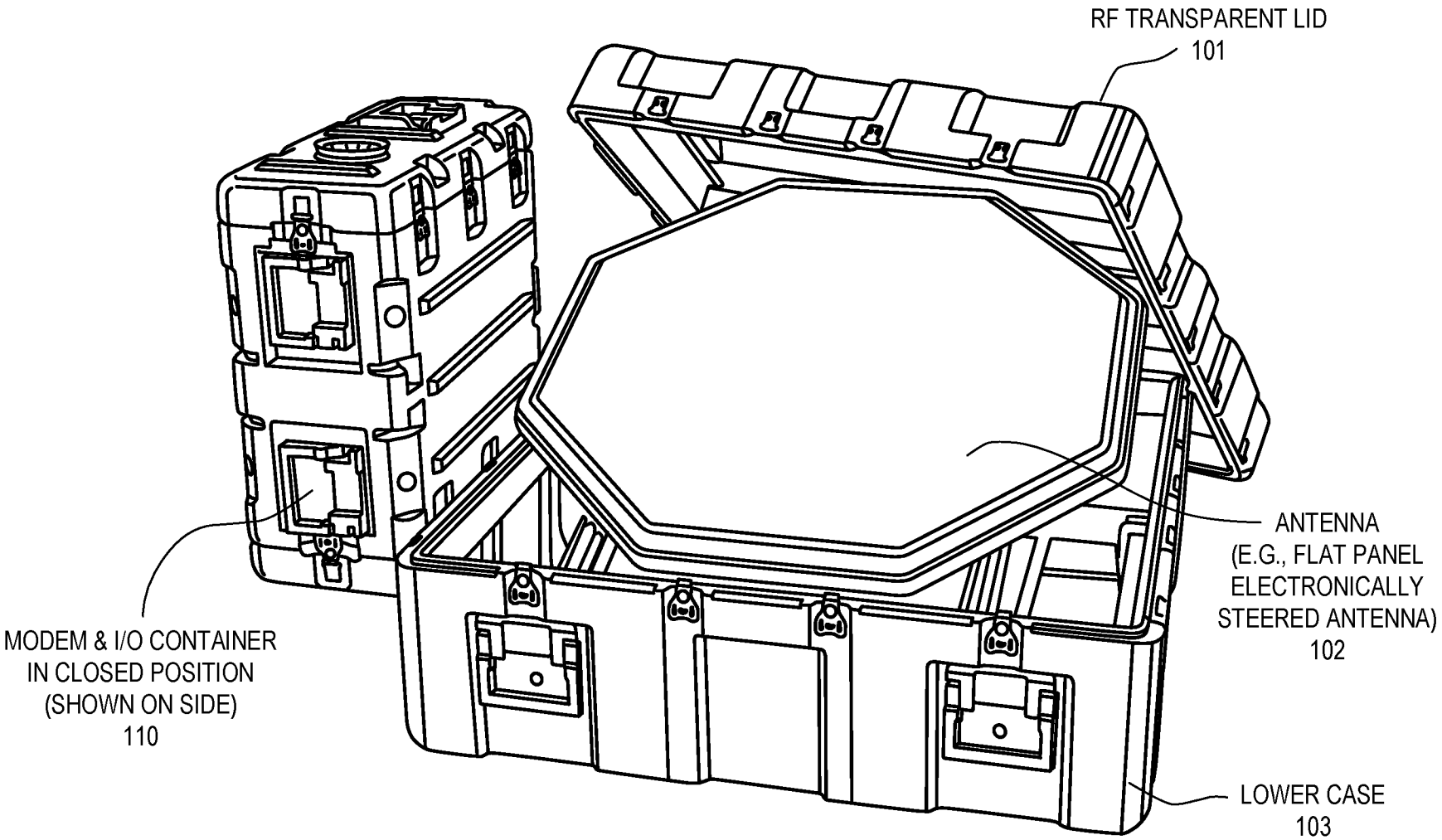
FIG. 1 illustrates one embodiment of a portable satellite antenna system.

FIG. 1 illustrates one embodiment of a portable satellite antenna system. Referring to FIG. 1, the portable satellite antenna system comprises a container to house a satellite antenna. In one embodiment, the container has a radio-frequency (RF) transparent lid 101 and a lower case 103. RF transparent lid 101 and lower case 103 house antenna 102. In one embodiment, antenna 102 comprises a flat-panel electronically steered antenna. Examples of such antennas are described in more detail below. The embodiments disclosed herein are not limited to use with the antennas described below, and other types of antennas may be used. For example, in alternative embodiments, the systems include a flat-panel antenna that is not electronically steered.

RF transparent lid 101, or portion thereof, comprises an RF transparent material through which antenna 102 is operable to transmit and receive satellite communications when lid 101 is on top of or otherwise covering the surface of antenna 102. Thus, in one embodiment, antenna 102 is able to transmit and receive satellite communications through the RF transparent portion of lid 101 during closed-container operation when the container is closed. In one embodiment, lid 101 operates as a radome of antenna 102.

In one embodiment, the RF transparent material of RF transparent lid 101 comprises a material tuned to frequencies at which the antenna is designed to operate. For example, the RF transparent material of RF transparent lid 101 is selected to enable antenna 102 to transmit and receive in the Ku-band in one embodiment or the Ka-band in another embodiment. Note that while in one embodiment material selection may be based on operation over an entire band, the material selection may be based on operation of the antenna with respect to a single frequency or a preferred frequency (or subset of frequencies) of a band.

The tuning of the material is also a function of its thickness and the distance of lid 101 from the transmit and receive surface of antenna 102. The thickness of lid 101 and distance of lid 101 from the surface of antenna 102 is such that it doesn't impede transmit and receive satellite communications of antenna 102. Such communications are not impeded if signals at the antenna's designed frequency or frequency band of operation are minimally attenuated or reflected by lid 101. In one embodiment, the distance between lid 101 and the surface of antenna 102 is dependent on the material used for the radome and the tuning. In one embodiment, the distance between lid 101 and the surface of antenna 102 is between ¼"-½" and is a function of radome tuning/thickness and could be greater.

In one embodiment, the design of lid 101 incorporates both RF and mechanical/environmental requirements. Several design approaches are available to the designer to address specific system requirements. For example, if the lid has minimal mechanical requirements, a very thin skin (e.g., <0.05 wavelength) of thermoplastic material can be used, while if structural rigidity is required, a solid half wave wall design (wherein the dielectric thickness of the wall is ½ wavelength) or sandwich construction may be appropriate. A specific design necessarily includes consideration of material dielectric properties, design approach, and antenna RF requirements. Design selections inherently embody tradeoffs between these typically conflicting requirements.

Typically, lid attenuation (e.g., insertion loss) will vary from 0.1's db to an amount in excess of 1.0 db depending upon lid design approach and antenna scan angles. Determination of acceptable attenuation is a system design trade off issue with due consideration of RF, mechanical and throughput requirements.

With respect to antenna-to-lid spacing, it is desirable to have the lid sufficiently removed from the antenna to minimize interactions (coupling) between the antenna and the lid (in this discussion, the antenna includes both the antennas radiating elements and any impedance matching layers (e.g., WAIM) above the antenna elements). It is also desirable to have the lid be spaced from the antenna such that reflections caused by the lid do not destructively interact with fields in the antenna. In one embodiment, a minimal distance of 0.25 wavelength is generally recommended to reduce lip to antenna coupling. A spacing of 0.5λ, (lambda) is not recommended because at this distance lid reflections will interact destructively with the antenna. In one embodiment, a spacing of 1.0 wavelength is preferred as it provides sufficient separation from the antenna and lid reflections constructively interact with fields in the antenna.

In one embodiment, RF transparent lid 101 comprises a thermoplastic material (e.g., polyethylene (e.g., low-density polyethylene (LDPE), high-density polyethylene (HDPE), etc.), polycarbonate used in either a thin skin or half wave wall construction. In another embodiment, the RF lid consists of a composite sandwich construction. In one embodiment in which lid 101 comprises LDPE, the thickness of lid 101 is approximately ¼". The thickness for a specific application is determined based upon antenna operational requirements and material dielectric properties. In one embodiment, lid 101 is made of HDPE and is ⅜" thick. Other examples of materials that may be used include polycarbonate and ABS plastic.

RF transparent lid 101 operates as the upper case that works with lower case 103 to form a closed container. Note that in one embodiment, the closed container is structurally sound such that it may be placed on any of its sides. In other words, RF transparent lid 101 comprises a material that is RF transparent and is structurally strong enough to support the container for transporting antenna 102. However, the material is also light-weight to enable the container with antenna 102 to be easily transported.

In one embodiment, the outer or externally exposed surface of lid 101 has a convex shape. The convex surface prevents liquids (e.g., rain water) from pooling on top of lid 101, which would cause attenuation in the transmit and receive satellite signals.

In one embodiment, an externally exposed portion of the at least one RF transparent surface has a hydrophobic coating. The hydrophobic coating causes water to bead, and thus, in cooperation with the convex shape of lid 101, causes water to roll off the surface of lid 101. Examples of coatings include Cytonix aerosol application hydrophobic coating and Cytonix Water Slip 41*p* additive for paint. Examples of coatings for super-hydrophobicity that may be used are RF-neutral and improve hydrophobicity include Mavcoat® XD and DryWired® Superhydrophobic Coating.

In one embodiment, the portable antenna system includes a modem and an input/output (I/O) mechanism for processing I/O operations in a manner well-known in the art. These may be transported in a container separate from the container that transports antenna 102.

An example of such a container is shown as modem and I/O container 110 in FIG. 1.

Figure 3:
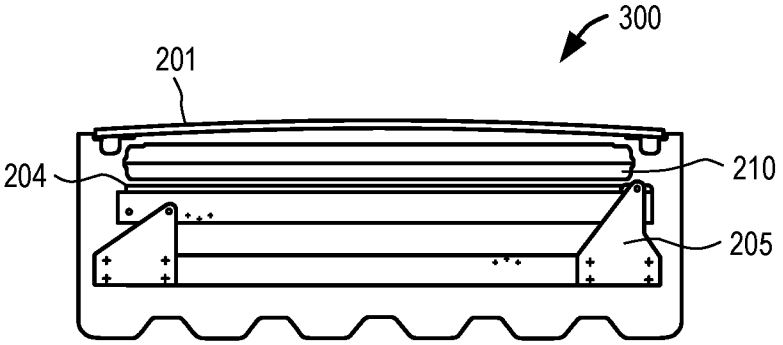
FIGS. 2 and 3 illustrate one embodiment of a container with an RF transparent lid.
Figure 2:
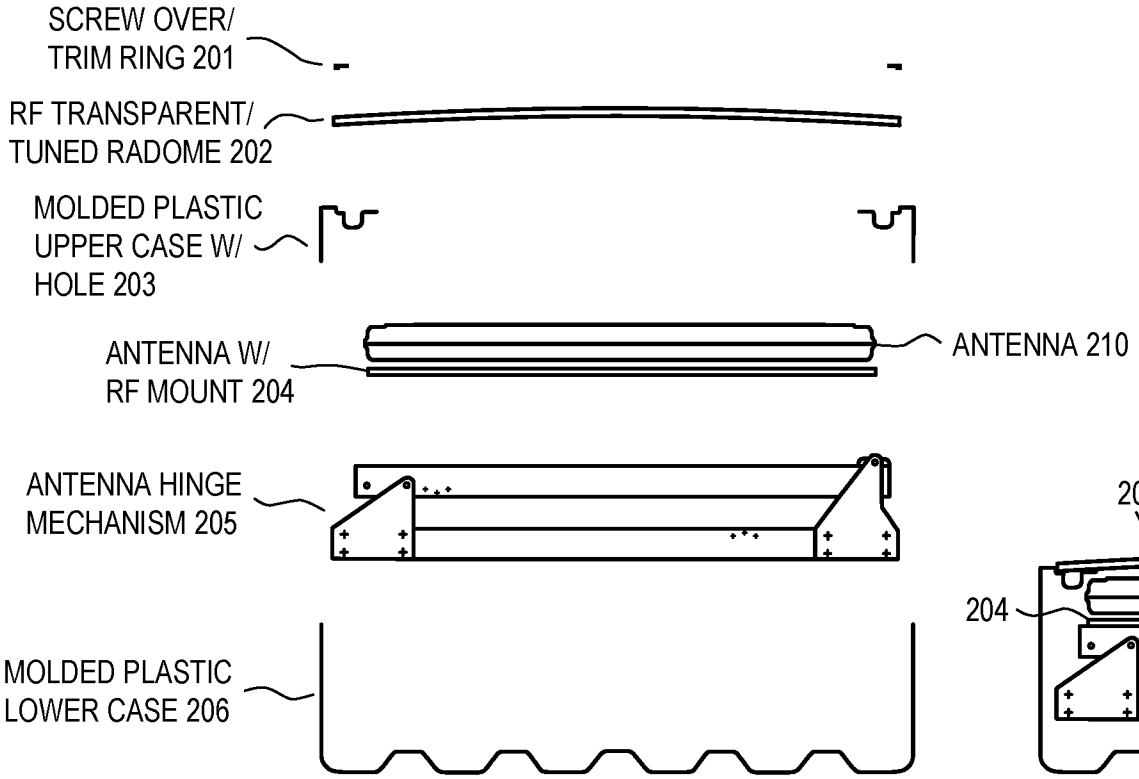

FIGS. 2 and 3 illustrate one embodiment of a container with an RF transparent lid. Referring to FIGS. 2 and 3, the container comprises a trim ring 201, radome 202, upper case 203, RF mount 204, antenna hinge mechanism 205, and lower case 206. Radome 202 is RF transparent and tuned as described above.

In one embodiment, radome 202 is secured to upper case 203 and covers a hole or opening in upper case 203. In one embodiment, trim ring 201 is used to cover fasteners on the top of the lid that secure radome 202 to upper case 203. Trim ring 201, radome 202 and upper case 203 form a lid when coupled together. Note that in alternative embodiments, trim ring 201 is not included.

In one embodiment, upper case 203 is a molded plastic upper case. In one embodiment, the plastic of the molded plastic upper case comprises polyethylene (e.g., low-density polyethylene (LDPE), high-density polyethylene (HDPE), etc.). In one embodiment, the fasteners comprise screws. However, other well-known types of fasteners may be used instead of screws.

The container includes an RF mount 204 upon which antenna 210 is coupled. In one embodiment, RF mount 204 comprises a plate having a number of RF components to which antenna 210 is coupled. In one embodiment, these components include a diplexer and components such as, for example, a low noise block down converter (LNBs) and a BUC (up-convert and high pass amplifier) that are typically found in an out-door unit (ODU).

RF mount 204 is coupled to an antenna hinge mechanism 205. In one embodiment, antenna hinge mechanism 205 allows the antenna to be positioned when the container is open and antenna 210 is exposed. In one embodiment, the hinge mechanism 205 comprises a mechanical elevation mechanism (non-motorized) that allows one side of antenna 210 to be moved to an inclined position to provide a desired look angle (e.g., the best look angle) at a satellite, facilitating network link establishment with the satellite. An example of inclined antenna positioning is shown in FIG. 1.

Hinge mechanism 205 is coupled or otherwise attached to lower case 206. In one embodiment, lower case 206 is a molded plastic upper case. In one embodiment, the plastic of the molded plastic upper case comprises polyethylene (e.g., low-density polyethylene (LDPE), high-density polyethylene (HDPE), etc.). Note that in alternative embodiments, lower case 206 is a different material than upper case 203.

FIG. 3 illustrates container 300 with trim ring 201, radome 202, upper case 203, RF mount 204, antenna hinge mechanism 205, and lower case 206 coupled together. In this configuration, in one embodiment, antenna 210 is able to operate in closed-container configuration to transmit and receive satellite communications. That is, even though the lid is still covering antenna 210, antenna 210 still operates to transmit and receive satellite signals through the lid. This is possible through the antenna's coarse alignment mechanism that allows accurate pointing, acquisition, and tracking capabilities of antenna 210 while in a flat or non-moving antenna position. In other words, antenna 210 with electronic scanning and an RF-transparent material in the lid of the container provide a capability to operate with the lid of the case on, with the case resting flat on the ground. In one embodiment, this facilitates inconspicuous use, which is particularly useful in avoiding detection and potential destruction due to Imagery Intelligence (IMINT) and Signals Intelligence (SIGINT), because adversaries will not be able to see the antenna, or distinguish the case as a piece of satellite communications equipment. When the upper case (including the lid) and the lower case are black, imagery intelligence will only reveal a non-descript, black case.

Figure 5:
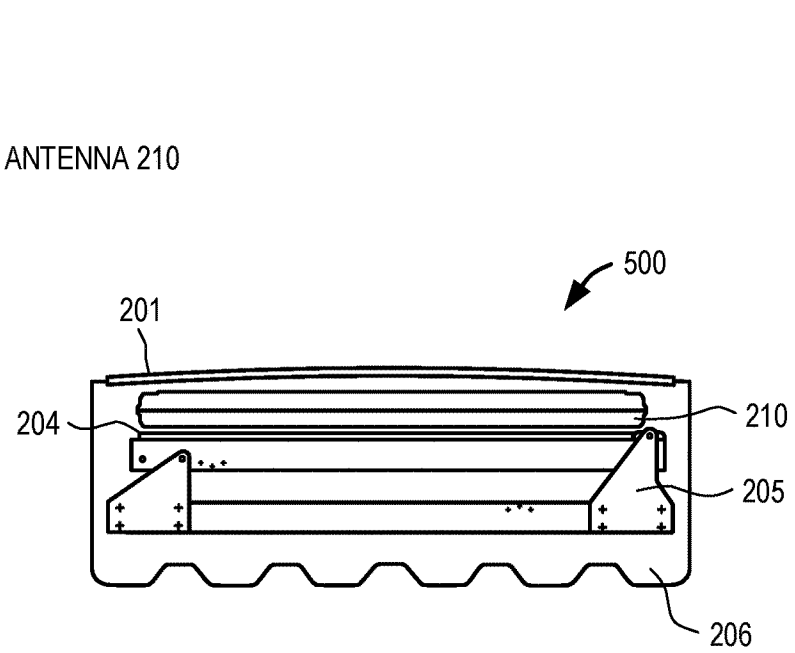
FIGS. 4 and 5 illustrate an alternative embodiment of a container with an RF transparent lid.
Figure 4:
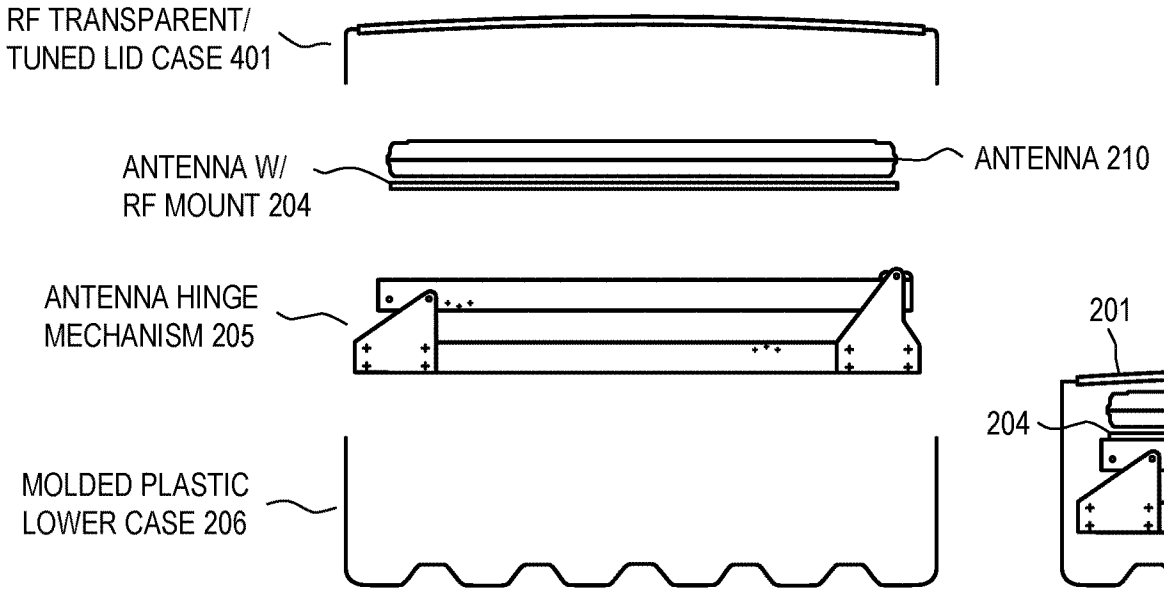

FIGS. 4 and 5 illustrate an alternative embodiment of a container with an RF transparent lid. Referring to FIGS. 4 and 5, the container comprises RF transparent lid 401, RF mount 204, antenna hinge mechanism 205, and lower case 206. Lid 401 acts as a radome and is RF transparent and tuned as described above. In one embodiment, lid 401 is a molded plastic upper case. In one embodiment, the plastic of the molded plastic upper case comprises polyethylene (e.g., low-density polyethylene (LDPE), linear polyethylene (HDPE), etc.).

The container includes an RF mount 204 upon which antenna 210 is coupled. In one embodiment, RF mount 204 comprises a plate having a number of RF components to which antenna 210 is coupled. In one embodiment, these components include a diplexer and components such as, for example, a low noise block down converter (LNBs) and a BUC (up-convert and high pass amplifier) that are typically found in an out-door unit (ODU).

RF mount 204 is coupled to an antenna hinge mechanism 205. In one embodiment, antenna hinge mechanism 205 allows the antenna to be positioned (e.g., inclined) when the container is open and antenna 210 is exposed. Hinge mechanism 205 is coupled or otherwise attached to lower case 206. Note that in alternative embodiments, lower case 206 is a different material than upper case 203.

FIG. 5 illustrates container 500 with RF transparent lid 201, RF mount 204, antenna hinge mechanism 205, and lower case 206 coupled together. In this configuration, in one embodiment, antenna 210 is able to operate in closed-container configuration to transmit and receive satellite communications.

In one embodiment, the container comprises a ruggedized case, such as one described above in conjunction with FIGS. 1-5, having outer dimensions that are 38.5" L×38.5" W×17.5" H and inner dimensions that are 35" L×35" W×13.5" H, while its weight is approximately 144 lbs. Note that the smaller case includes a modem. In one embodiment of the operational configuration, the equipment in the cases is connected by three cables (e.g., I/O cable plus two RF cables). In an alternative embodiment, all the components are contained in the container and there is no need for cable connections.

In one embodiment, the portable antenna system is used by law enforcement or military as a full-spectrum protected communications system with full interconnectivity to public safety and first responder networks for disaster response and humanitarian assistance. In one embodiment, the portable antenna system allows for seamless communications across terrestrial and on-orbit networks anywhere in the world. In one embodiment, the portable antenna system aggregates a wide variety of networking and computing capabilities to provide a continuous and interconnected communications experience over satellite, airborne and terrestrial networks, thereby enabling rapid establishment of essential communications in any environment.

In one embodiment, embodiments of the portable antenna system disclosed herein greatly reduce the need to deploy SATCOM technicians and to manually point the antenna for operations. Furthermore, it can be rapidly moved from site-to-site to provide satellite communications without the time-consuming satellite locating requirements associated with traditional deployable VSATs.

Embodiments of a portable flat panel antenna container system have one or more of a number of innovations. These innovations include, but are not limited to, the following:

1) incorporates flat panel antenna into rugged, weather resistant, man-portable cases, capable of being transported as checked baggage on commercial aircraft;
2) scalable and modular configuration—configurable to include any or all the following capabilities: ruggedized edge compute stack, ruggedized edge router capable of link bonding, least cost routing and traffic/datalink prioritization, establishment of multiple 4G LTE/5G networks, connection to LTE/5G small cellular including public safety and unlicensed bands, rugged 802.11 WiFi, connection to Project 25 (P25) public safety radios, connection to POTS lines, and connection to and bridging of tactical radios utilizing the Soldier Radio Waveform (SRW) and Adaptive Networking Wideband Waveform (ANW2C);
3) includes a self-contained power source. The use of the self-contained power source facilitates use of the antenna in austere locations. In one embodiment, the power source comprises lithium ion battery packs. In one embodiment, the power source comprises solar panels;
4) has beyond Line of Sight (BLOS) connectivity through constellations of Low Earth Orbit (LEO) and Geostationary (GEO) satellites;
5) indoor unit components housed in rugged, weather resistant, man-portable case
6) case-mounted rings enable mounting to truck beds, vessel decks or vehicle roofs, facilitating on-the-move operation;
7) a quick release antenna and RF mounting system capable of moving from antenna case to vehicle roof racks;
8) springs included in a ruggedized case allow the antenna to withstand shocks that may be cause by dropping the case with the antenna inside.

In one embodiment, the antenna is a rapidly deployable networking system. In one embodiment, the rapidly deployable networking system supports personnel, organizations and agencies with establishment of, connectivity to and bridging of a broad range of terrestrial and on-orbit networks. In one embodiment, the system supports traditional VSAT networks through the satellite terminal with the ability to connect to LEO and GEO satellite constellations. In one embodiment, additional terrestrial and airborne network connections are created and bridges to enable full-spectrum communications in a deployed environment. In one embodiment, the entire system is capable of operating as a self-contained and self-powered system (e.g., lithium ion batteries, solar panels, etc.) or may be connected to available power sources.

Embodiments of the antenna include one or more of the following advantages.

First, in one embodiment, the antenna configuration enables a portable solution for communications on the pause (COTP) or communications on the move (COTM) operation without a custom mounting solution, designed to operate from within the container. In one embodiment, the container is designed with D rings so that tie downs may be used to mount the antenna to a platform, such as, for example, a vehicle or vessel.

Time from deployment to operations is approximately 5 minutes and typically does not require a subject matter expert. Average time for traditional VSATs from deployment to operations is approximately 90 minutes (minimum) and requires a SATCOM technician.

The interconnected network architecture allows for communication from anywhere in the world to anywhere in the world. For example, a disaster recovery individual in a disaster zone can communicate via push to talk radios to personnel within range of the radio as well as support personnel on a cellular telephone on another continent without changing devices or physically connecting to a different network. This reduces the handheld communications equipment personnel must carry but allows assured communication.

In one embodiment, the antenna includes a coarse alignment mechanism. Because of the accurate pointing, acquisition, and tracking capabilities of flat panel antenna, a precise alignment mechanism is not needed for the surface of the antenna. That is, embodiments of the container containing a flat panel antenna with electronic scanning, in conjunction with an RF-transparent material in the lid of the case, provide a unique capability to operate with the lid of the case on, with the case resting flat on the ground, thereby providing for inconspicuous use. Therefore, adversaries will not be able to see the antenna, or distinguish the case as a piece of satellite communications equipment. Imagery intelligence will only reveal a non-descript, black case.

In one embodiment, the case used to house the antenna has a thin profile, which is a distinct advantage over existing portable airtight, watertight temperature-controlled packaging and protective systems used for dish-type VSAT. The thin case profile and wheel assembly is non-obvious because it is enabled by the flat-panel antenna. The case, including the wheels, enables the antenna system to be easily roll through doorways and other narrow spaces.

Examples of Antenna Embodiments

The techniques described above may be used with flat panel antennas. Embodiments of such flat panel antennas are disclosed. The flat panel antennas include one or more arrays of antenna elements on an antenna aperture. In one embodiment, the antenna elements comprise liquid crystal cells. In one embodiment, the flat panel antenna is a cylindrically fed antenna that includes matrix drive circuitry to uniquely address and drive each of the antenna elements that are not placed in rows and columns. In one embodiment, the elements are placed in rings.

In one embodiment, the antenna aperture having the one or more arrays of antenna elements is comprised of multiple segments coupled together. When coupled together, the combination of the segments form closed concentric rings of antenna elements. In one embodiment, the concentric rings are concentric with respect to the antenna feed.

Examples of Antenna Systems

In one embodiment, the flat panel antenna is part of a metamaterial antenna system. Embodiments of a metamaterial antenna system for communications satellite earth stations are described. In one embodiment, the antenna system is a component or subsystem of a satellite earth station (ES) operating on a mobile platform (e.g., aeronautical, maritime, land, etc.) that operates using either Ka-band frequencies or Ku-band frequencies for civil commercial satellite communications. Note that embodiments of the antenna system also can be used in earth stations that are not on mobile platforms (e.g., fixed or transportable earth stations).

In one embodiment, the antenna system uses surface scattering metamaterial technology to form and steer transmit and receive beams through separate antennas. In one embodiment, the antenna systems are analog systems, in contrast to antenna systems that employ digital signal processing to electrically form and steer beams (such as phased array antennas).

In one embodiment, the antenna system is comprised of three functional subsystems: (1) a wave guiding structure consisting of a cylindrical wave feed architecture; (2) an array of wave scattering metamaterial unit cells that are part of antenna elements; and (3) a control structure to command formation of an adjustable radiation field (beam) from the metamaterial scattering elements using holographic principles.

Antenna Elements

Figure 6:
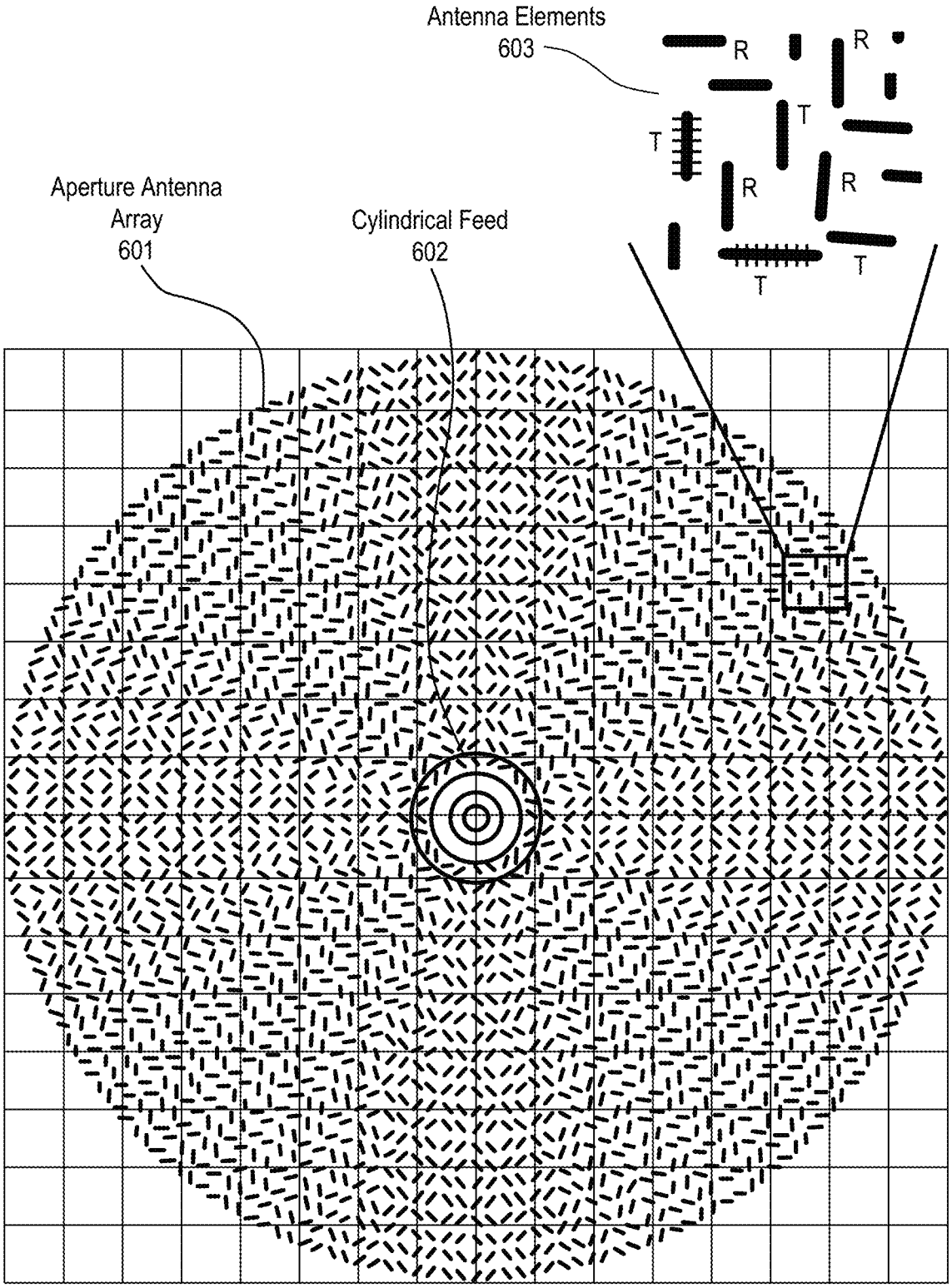
FIG. 6 illustrates the schematic of one embodiment of a cylindrically fed holographic radial aperture antenna.

FIG. 6 illustrates the schematic of one embodiment of a cylindrically fed holographic radial aperture antenna. Referring to FIG. 6, the antenna aperture has one or more arrays 601 of antenna elements 603 that are placed in concentric rings around an input feed 602 of the cylindrically fed antenna. In one embodiment, antenna elements 603 are radio frequency (RF) resonators that radiate RF energy. In one embodiment, antenna elements 603 comprise both Rx and Tx irises that are interleaved and distributed on the whole surface of the antenna aperture. Such Rx and Tx irises, or slots, may be in groups of three or more sets where each set is for a separately and simultaneously controlled band. Examples of such antenna elements with irises are described in greater detail below. Note that the RF resonators described herein may be used in antennas that do not include a cylindrical feed.

In one embodiment, the antenna includes a coaxial feed that is used to provide a cylindrical wave feed via input feed 602. In one embodiment, the cylindrical wave feed architecture feeds the antenna from a central point with an excitation that spreads outward in a cylindrical manner from the feed point. That is, a cylindrically fed antenna creates an outward travelling concentric feed wave. Even so, the shape of the cylindrical feed antenna around the cylindrical feed can be circular, square or any shape. In another embodiment, a cylindrically fed antenna creates an inward travelling feed wave. In such a case, the feed wave most naturally comes from a circular structure.

In one embodiment, antenna elements 603 comprise irises and the aperture antenna of FIG. 6 is used to generate a main beam shaped by using excitation from a cylindrical feed wave for radiating irises through tunable liquid crystal (LC) material. In one embodiment, the antenna can be excited to radiate a horizontally or vertically polarized electric field at desired scan angles.

In one embodiment, the antenna elements comprise a group of patch antennas. This group of patch antennas comprises an array of scattering metamaterial elements. In one embodiment, each scattering element in the antenna system is part of a unit cell that consists of a lower conductor, a dielectric substrate and an upper conductor that embeds a complementary electric inductive-capacitive resonator ("complementary electric LC" or "CELC") that is etched in or deposited onto the upper conductor. As would be understood by those skilled in the art, LC in the context of CELC refers to inductance-capacitance, as opposed to liquid crystal.

In one embodiment, a liquid crystal (LC) is disposed in the gap around the scattering element. This LC is driven by the direct drive embodiments described above. In one embodiment, liquid crystal is encapsulated in each unit cell and separates the lower conductor associated with a slot from an upper conductor associated with its patch. Liquid crystal has a permittivity that is a function of the orientation of the molecules comprising the liquid crystal, and the orientation of the molecules (and thus the permittivity) can be controlled by adjusting the bias voltage across the liquid crystal. Using this property, in one embodiment, the liquid crystal integrates an on/off switch for the transmission of energy from the guided wave to the CELC. When switched on, the CELC emits an electromagnetic wave like an electrically small dipole antenna. Note that the teachings herein are not limited to having a liquid crystal that operates in a binary fashion with respect to energy transmission.

In one embodiment, the feed geometry of this antenna system allows the antenna elements to be positioned at forty-five-degree (45°) angles to the vector of the wave in the wave feed. Note that other positions may be used (e.g., at 40° angles). This position of the elements enables control of the free space wave received by or transmitted/radiated from the elements. In one embodiment, the antenna elements are arranged with an inter-element spacing that is less than a free-space wavelength of the operating frequency of the antenna. For example, if there are four scattering elements per wavelength, the elements in the 30 GHz transmit antenna will be approximately 2.5 mm (i.e., ¼th the 10 mm free-space wavelength of 30 GHz).

In one embodiment, the two sets of elements are perpendicular to each other and simultaneously have equal amplitude excitation if controlled to the same tuning state. Rotating them +/−45 degrees relative to the feed wave excitation achieves both desired features at once. Rotating one set 0 degrees and the other 90 degrees would achieve the perpendicular goal, but not the equal amplitude excitation goal. Note that 0 and 90 degrees may be used to achieve isolation when feeding the array of antenna elements in a single structure from two sides.

The amount of radiated power from each unit cell is controlled by applying a voltage to the patch (potential across the LC channel) using a controller. Traces to each patch are used to provide the voltage to the patch antenna. The voltage is used to tune or detune the capacitance and thus the resonance frequency of individual elements to effectuate beam forming. The voltage required is dependent on the liquid crystal mixture being used. The voltage tuning characteristic of liquid crystal mixtures is mainly described by a threshold voltage at which the liquid crystal starts to be affected by the voltage and the saturation voltage, above which an increase of the voltage does not cause major tuning in liquid crystal. These two characteristic parameters can change for different liquid crystal mixtures.

In one embodiment, as discussed above, a matrix drive is used to apply voltage to the patches in order to drive each cell separately from all the other cells without having a separate connection for each cell (direct drive). Because of the high density of elements, the matrix drive is an efficient way to address each cell individually.

In one embodiment, the control structure for the antenna system has 2 main components: the antenna array controller, which includes drive electronics, for the antenna system, is below the wave scattering structure (of surface scattering antenna elements such as described herein), while the matrix drive switching array is interspersed throughout the radiating RF array in such a way as to not interfere with the radiation. In one embodiment, the drive electronics for the antenna system comprise commercial off-the shelf LCD controls used in commercial television appliances that adjust the bias voltage for each scattering element by adjusting the amplitude or duty cycle of an AC bias signal to that element.

In one embodiment, the antenna array controller also contains a microprocessor executing the software. The control structure may also incorporate sensors (e.g., a GPS receiver, a three-axis compass, a 3-axis accelerometer, 3-axis gyro, 3-axis magnetometer, etc.) to provide location and orientation information to the processor. The location and orientation information may be provided to the processor by other systems in the earth station and/or may not be part of the antenna system.

More specifically, the antenna array controller controls which elements are turned off and those elements turned on and at which phase and amplitude level at the frequency of operation. The elements are selectively detuned for frequency operation by voltage application.

For transmission, a controller supplies an array of voltage signals to the RF patches to create a modulation, or control pattern. The control pattern causes the elements to be turned to different states. In one embodiment, multistate control is used in which various elements are turned on and off to varying levels, further approximating a sinusoidal control pattern, as opposed to a square wave (i.e., a sinusoid gray shade modulation pattern). In one embodiment, some elements radiate more strongly than others, rather than some elements radiate and some do not. Variable radiation is achieved by applying specific voltage levels, which adjusts the liquid crystal permittivity to varying amounts, thereby detuning elements variably and causing some elements to radiate more than others.

The generation of a focused beam by the metamaterial array of elements can be explained by the phenomenon of constructive and destructive interference. Individual electromagnetic waves sum up (constructive interference) if they have the same phase when they meet in free space and waves cancel each other (destructive interference) if they are in opposite phase when they meet in free space. If the slots in a slotted antenna are positioned so that each successive slot is positioned at a different distance from the excitation point of the guided wave, the scattered wave from that element will have a different phase than the scattered wave of the previous slot. If the slots are spaced one quarter of a guided wavelength apart, each slot will scatter a wave with a one fourth phase delay from the previous slot.

Using the array, the number of patterns of constructive and destructive interference that can be produced can be increased so that beams can be pointed theoretically in any direction plus or minus ninety degrees (90°) from the bore sight of the antenna array, using the principles of holography. Thus, by controlling which metamaterial unit cells are turned on or off (i.e., by changing the pattern of which cells are turned on and which cells are turned off), a different pattern of constructive and destructive interference can be produced, and the antenna can change the direction of the main beam. The time required to turn the unit cells on and off dictates the speed at which the beam can be switched from one location to another location.

In one embodiment, the antenna system produces one steerable beam for the uplink antenna and one steerable beam for the downlink antenna. In one embodiment, the antenna system uses metamaterial technology to receive beams and to decode signals from the satellite and to form transmit beams that are directed toward the satellite. In one embodiment, the antenna systems are analog systems, in contrast to antenna systems that employ digital signal processing to electrically form and steer beams (such as phased array antennas). In one embodiment, the antenna system is considered a "surface" antenna that is planar and relatively low profile, especially when compared to conventional satellite dish receivers.

Figure 7:
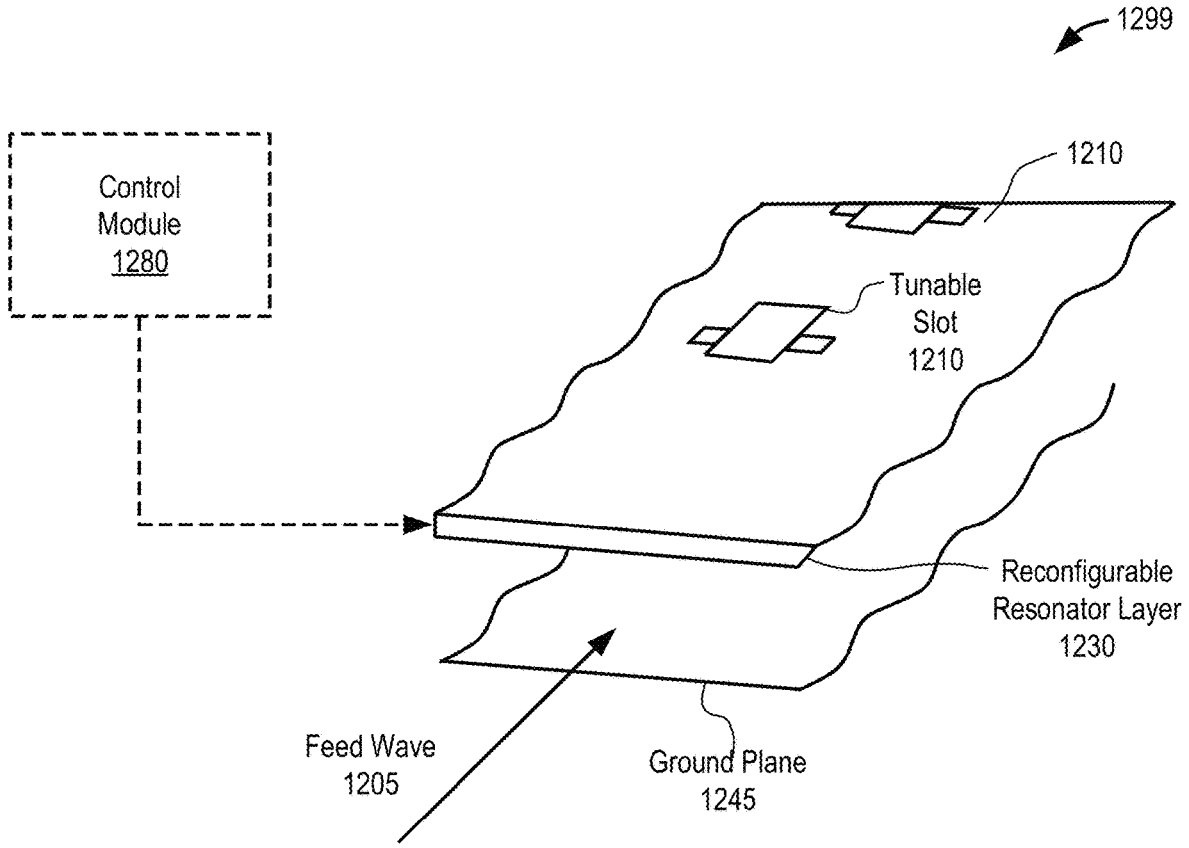
FIG. 7 illustrates a perspective view of one row of antenna elements that includes a ground plane and a reconfigurable resonator layer.

FIG. 7 illustrates a perspective view of one row of antenna elements that includes a ground plane and a reconfigurable resonator layer. Reconfigurable resonator layer 1230 includes an array of tunable slots 1210. The array of tunable slots 1210 can be configured to point the antenna in a desired direction. Each of the tunable slots can be tuned/adjusted by varying a voltage across the liquid crystal.

Figure 8A:
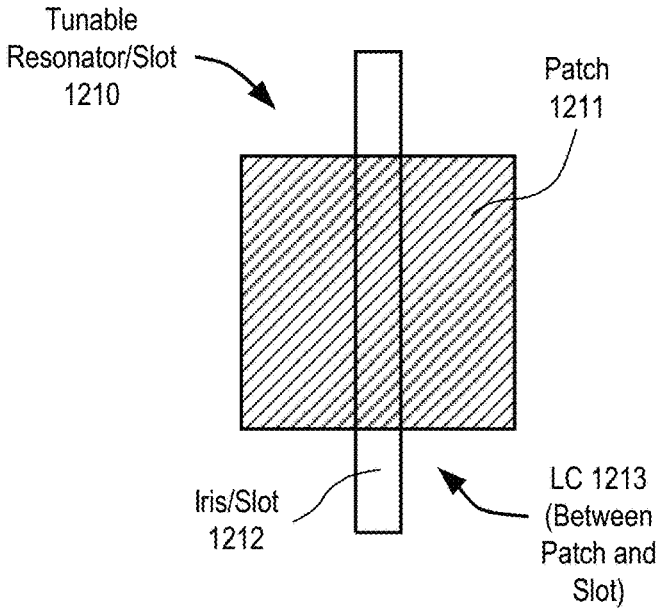
FIG. 8A illustrates one embodiment of a tunable resonator/slot.

Control module, or controller, 1280 is coupled to reconfigurable resonator layer 1230 to modulate the array of tunable slots 1210 by varying the voltage across the liquid crystal in FIG. 8A. Control module 1280 may include a Field Programmable Gate Array ("FPGA"), a microprocessor, a controller, System-on-a-Chip (SoC), or other processing logic. In one embodiment, control module 1280 includes logic circuitry (e.g., multiplexer) to drive the array of tunable slots 1210. In one embodiment, control module 1280 receives data that includes specifications for a holographic diffraction pattern to be driven onto the array of tunable slots 1210. The holographic diffraction patterns may be generated in response to a spatial relationship between the antenna and a satellite so that the holographic diffraction pattern steers the downlink beams (and uplink beam if the antenna system performs transmit) in the appropriate direction for communication. Although not drawn in each figure, a control module similar to control module 1280 may drive each array of tunable slots described in the figures of the disclosure.

Radio Frequency ("RF") holography is also possible using analogous techniques where a desired RF beam can be generated when an RF reference beam encounters an RF holographic diffraction pattern. In the case of satellite communications, the reference beam is in the form of a feed wave, such as feed wave 1205 (approximately 20 GHz in some embodiments). To transform a feed wave into a radiated beam (either for transmitting or receiving purposes), an interference pattern is calculated between the desired RF beam (the object beam) and the feed wave (the reference beam). The interference pattern is driven onto the array of tunable slots 1210 as a diffraction pattern so that the feed wave is "steered" into the desired RF beam (having the desired shape and direction). In other words, the feed wave encountering the holographic diffraction pattern "reconstructs" the object beam, which is formed according to design requirements of the communication system. The holographic diffraction pattern contains the excitation of each element and is calculated by $w_{hologram}=w^*_{in}w_{out}$, with win as the wave equation in the waveguide and $w_{out}$ the wave equation on the outgoing wave.

FIG. 8A illustrates one embodiment of a tunable resonator/slot 1210. Tunable slot 1210 includes an iris/slot 1212, a radiating patch 1211, and liquid crystal 1213 disposed between iris 1212 and patch 1211. In one embodiment, radiating patch 1211 is co-located with iris 1212.

Figure 8B:
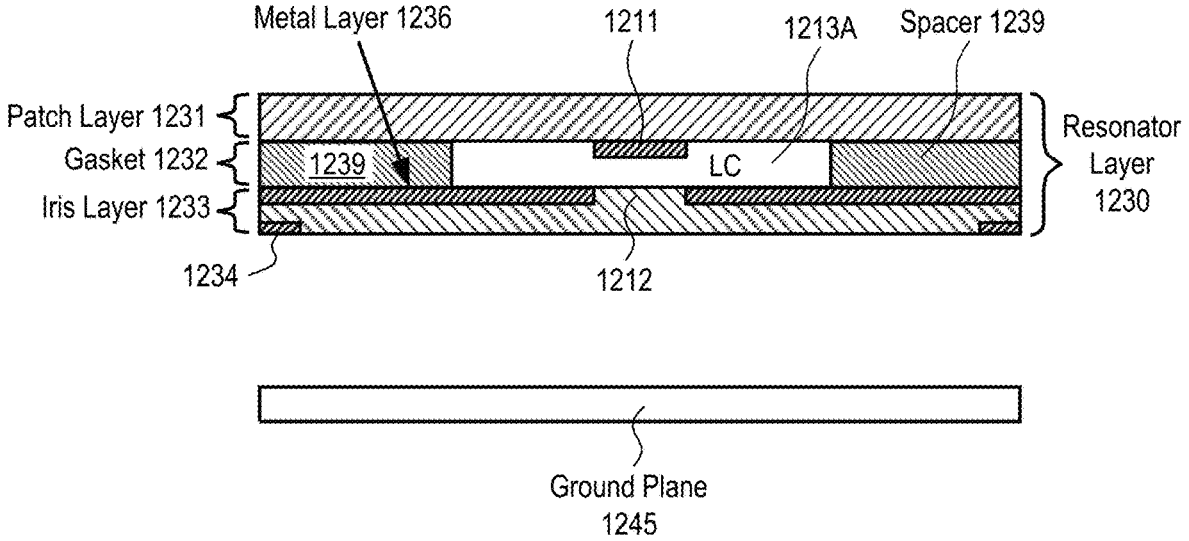
FIG. 8B illustrates a cross section view of one embodiment of a physical antenna aperture.

FIG. 8B illustrates a cross section view of one embodiment of a physical antenna aperture. The antenna aperture includes ground plane 1245, and a metal layer 1236 within iris layer 1233, which is included in reconfigurable resonator layer 1230. In one embodiment, the antenna aperture of FIG. 8B includes a plurality of tunable resonator/slots 1210 of FIG. 8A. Iris/slot 1212 is defined by openings in metal layer 1236. A feed wave, such as feed wave 1205 of FIG. 8A, may have a microwave frequency compatible with satellite communication channels. The feed wave propagates between ground plane 1245 and resonator layer 1230.

Reconfigurable resonator layer 1230 also includes gasket layer 1232 and patch layer 1231. Gasket layer 1232 is disposed between patch layer 1231 and iris layer 1233. Note that in one embodiment, a spacer could replace gasket layer 1232. In one embodiment, iris layer 1233 is a printed circuit board ("PCB") that includes a copper layer as metal layer 1236. In one embodiment, iris layer 1233 is glass. Iris layer 1233 may be other types of substrates.

Openings may be etched in the copper layer to form slots 1212. In one embodiment, iris layer 1233 is conductively coupled by a conductive bonding layer to another structure (e.g., a waveguide) in FIG. 8B. Note that in an embodiment the iris layer is not conductively coupled by a conductive bonding layer and is instead interfaced with a non-conducting bonding layer.

Patch layer 1231 may also be a PCB that includes metal as radiating patches 1211. In one embodiment, gasket layer 1232 includes spacers 1239 that provide a mechanical standoff to define the dimension between metal layer 1236 and patch 1211. In one embodiment, the spacers are 75 microns, but other sizes may be used (e.g., 3-200 mm). As mentioned above, in one embodiment, the antenna aperture of FIG. 8B includes multiple tunable resonator/slots, such as tunable resonator/slot 1210 includes patch 1211, liquid crystal 1213, and iris 1212 of FIG. 8A. The chamber for liquid crystal 1213 is defined by spacers 1239, iris layer 1233 and metal layer 1236. When the chamber is filled with liquid crystal, patch layer 1231 can be laminated onto spacers 1239 to seal liquid crystal within resonator layer 1230.

A voltage between patch layer 1231 and iris layer 1233 can be modulated to tune the liquid crystal in the gap between the patch and the slots (e.g., tunable resonator/slot 1210). Adjusting the voltage across liquid crystal 1213 varies the capacitance of a slot (e.g., tunable resonator/slot 1210). Accordingly, the reactance of a slot (e.g., tunable resonator/slot 1210) can be varied by changing the capacitance. Resonant frequency of slot 1210 also changes according to the equator $$f = \frac{1}{2\pi\sqrt{LC}}$$

where f is me resonant frequency of slot 1210 and L and C are the inductance and capacitance of slot 1210, respectively. The resonant frequency of slot 1210 affects the energy radiated from feed wave 1205 propagating through the waveguide. As an example, if feed wave 1205 is 20 GHz, the resonant frequency of a slot 1210 may be adjusted (by varying the capacitance) to 17 GHz so that the slot 1210 couples substantially no energy from feed wave 1205. Or, the resonant frequency of a slot 1210 may be adjusted to 20 GHz so that the slot 1210 couples energy from feed wave 1205 and radiates that energy into free space. Although the examples given are binary (fully radiating or not radiating at all), full gray scale control of the reactance, and therefore the resonant frequency of slot 1210 is possible with voltage variance over a multi-valued range. Hence, the energy radiated from each slot 1210 can be finely controlled so that detailed holographic diffraction patterns can be formed by the array of tunable slots.

In one embodiment, tunable slots in a row are spaced from each other by λ/5. Other spacings may be used. In one embodiment, each tunable slot in a row is spaced from the closest tunable slot in an adjacent row by λ/2, and, thus, commonly oriented tunable slots in different rows are spaced by λ/4, though other spacings are possible (e.g., λ/5, λ/6.3). In another embodiment, each tunable slot in a row is spaced from the closest tunable slot in an adjacent row by λ/3.

Embodiments use reconfigurable metamaterial technology, such as described in U.S. patent application Ser. No. 14/550,178, entitled "Dynamic Polarization and Coupling Control from a Steerable Cylindrically Fed Holographic Antenna", filed Nov. 21, 2014 and U.S. patent application Ser. No. 14/610,502, entitled "Ridged Waveguide Feed Structures for Reconfigurable Antenna", filed Jan. 30, 2015.

FIGS. 9A-D illustrate one embodiment of the different layers for creating the slotted array. The antenna array includes antenna elements that are positioned in rings, such as the example rings shown in FIG. 1A. Note that in this example the antenna array has two different types of antenna elements that are used for two different types of frequency bands.

Figure 9A:
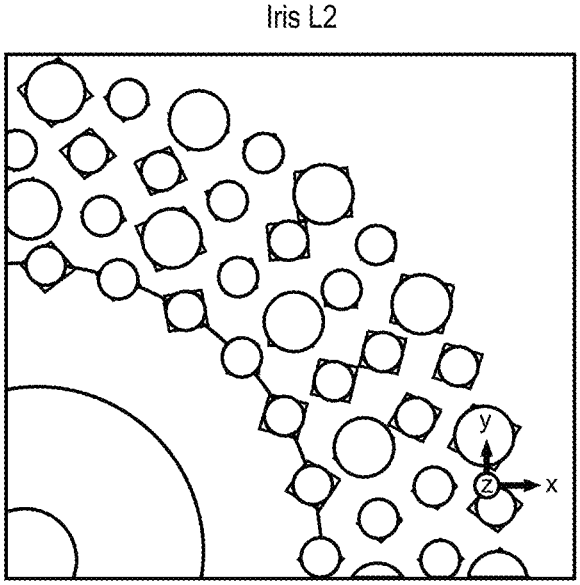
FIGS. 9A-D illustrate one embodiment of the different layers for creating the slotted array.
Figure 9B:
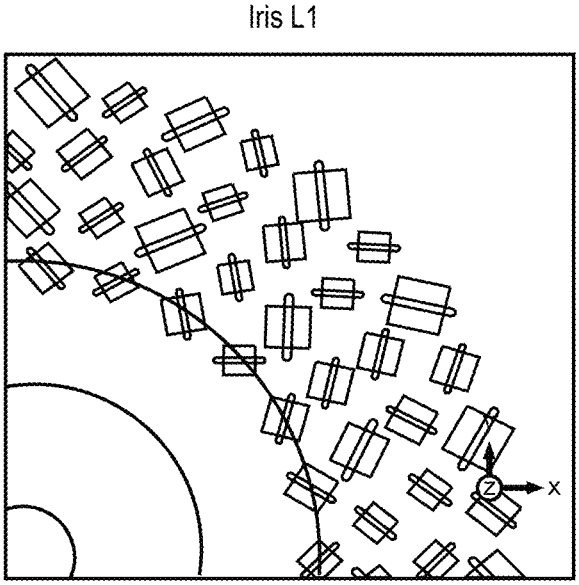
Figure 9C:
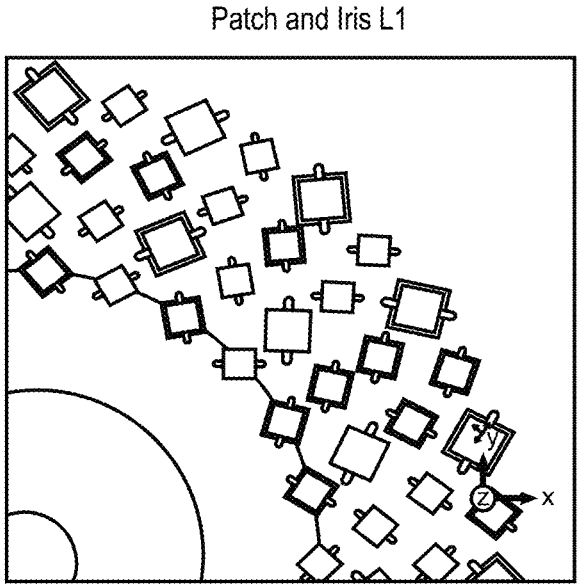
Figure 9D:
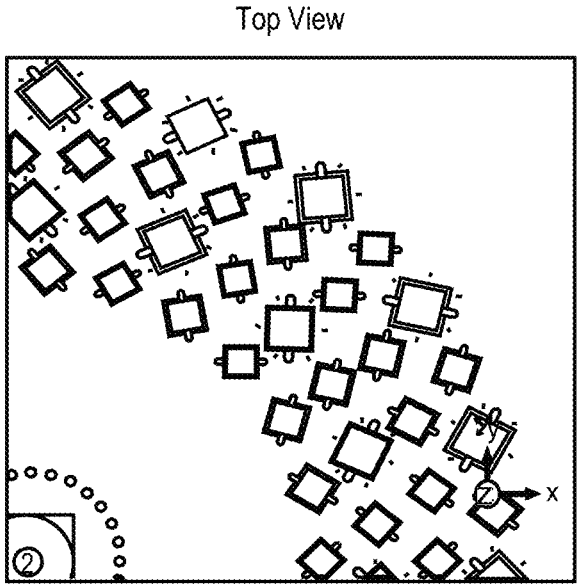

FIG. 9A illustrates a portion of the first iris board layer with locations corresponding to the slots. Referring to FIG. 9A, the circles are open areas/slots in the metallization in the bottom side of the iris substrate, and are for controlling the coupling of elements to the feed (the feed wave). Note that this layer is an optional layer and is not used in all designs. FIG. 9B illustrates a portion of the second iris board layer containing slots. FIG. 9C illustrates patches over a portion of the second iris board layer. FIG. 9D illustrates a top view of a portion of the slotted array.

Figure 10:
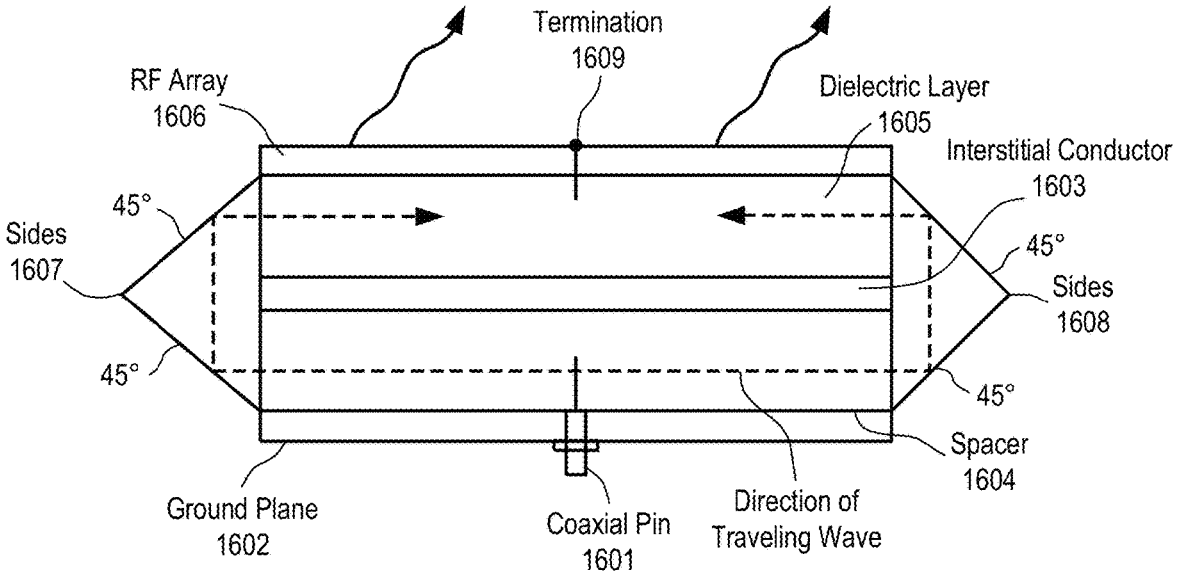
FIG. 10 illustrates a side view of one embodiment of a cylindrically fed antenna structure.

FIG. 10 illustrates a side view of one embodiment of a cylindrically fed antenna structure. The antenna produces an inwardly travelling wave using a double layer feed structure (i.e., two layers of a feed structure). In one embodiment, the antenna includes a circular outer shape, though this is not required. That is, non-circular inward travelling structures can be used. In one embodiment, the antenna structure in FIG. 10 includes a coaxial feed, such as, for example, described in U.S. Publication No. 2015/0236412, entitled "Dynamic Polarization and Coupling Control from a Steerable Cylindrically Fed Holographic Antenna", filed on Nov. 21, 2014.

Referring to FIG. 10, a coaxial pin 1601 is used to excite the field on the lower level of the antenna. In one embodiment, coaxial pin 1601 is a 50Ω coax pin that is readily available. Coaxial pin 1601 is coupled (e.g., bolted) to the bottom of the antenna structure, which is conducting ground plane 1602.

Separate from conducting ground plane 1602 is interstitial conductor 1603, which is an internal conductor. In one embodiment, conducting ground plane 1602 and interstitial conductor 1603 are parallel to each other. In one embodiment, the distance between ground plane 1602 and interstitial conductor 1603 is 0.1-0.15". In another embodiment, this distance may be λ/2, where λ is the wavelength of the travelling wave at the frequency of operation.

Ground plane 1602 is separated from interstitial conductor 1603 via a spacer 1604. In one embodiment, spacer 1604 is a foam or air-like spacer. In one embodiment, spacer 1604 comprises a plastic spacer.

On top of interstitial conductor 1603 is dielectric layer 1605. In one embodiment, dielectric layer 1605 is plastic. The purpose of dielectric layer 1605 is to slow the travelling wave relative to free space velocity. In one embodiment, dielectric layer 1605 slows the travelling wave by 30% relative to free space. In one embodiment, the range of indices of refraction that are suitable for beam forming are 1.2-1.8, where free space has by definition an index of refraction equal to 1. Other dielectric spacer materials, such as, for example, plastic, may be used to achieve this effect. Note that materials other than plastic may be used as long as they achieve the desired wave slowing effect. Alternatively, a material with distributed structures may be used as dielectric 1605, such as periodic sub-wavelength metallic structures that can be machined or lithographically defined, for example.

An RF-array 1606 is on top of dielectric 1605. In one embodiment, the distance between interstitial conductor 1603 and RF-array 1606 is 0.1-0.15". In another embodiment, this distance may be $\lambda_{eff}/2$, where $\lambda_{eff}$ is the effective wavelength in the medium at the design frequency.

The antenna includes sides 1607 and 1608. Sides 1607 and 1608 are angled to cause a travelling wave feed from coax pin 1601 to be propagated from the area below interstitial conductor 1603 (the spacer layer) to the area above interstitial conductor 1603 (the dielectric layer) via reflection. In one embodiment, the angle of sides 1607 and 1608 are at 45° angles. In an alternative embodiment, sides 1607 and 1608 could be replaced with a continuous radius to achieve the reflection. While FIG. 10 shows angled sides that have angle of 45 degrees, other angles that accomplish signal transmission from lower level feed to upper level feed may be used. That is, given that the effective wavelength in the lower feed will generally be different than in the upper feed, some deviation from the ideal 45° angles could be used to aid transmission from the lower to the upper feed level. For example, in another embodiment, the 45° angles are replaced with a single step. The steps on one end of the antenna go around the dielectric layer, interstitial the conductor, and the spacer layer. The same two steps are at the other ends of these layers.

In operation, when a feed wave is fed in from coaxial pin 1601, the wave travels outward concentrically oriented from coaxial pin 1601 in the area between ground plane 1602 and interstitial conductor 1603. The concentrically outgoing waves are reflected by sides 1607 and 1608 and travel inwardly in the area between interstitial conductor 1603 and RF array 1606. The reflection from the edge of the circular perimeter causes the wave to remain in phase (i.e., it is an in-phase reflection). The travelling wave is slowed by dielectric layer 1605. At this point, the travelling wave starts interacting and exciting with elements in RF array 1606 to obtain the desired scattering.

To terminate the travelling wave, a termination 1609 is included in the antenna at the geometric center of the antenna. In one embodiment, termination 1609 comprises a pin termination (e.g., a 50Ω pin). In another embodiment, termination 1609 comprises an RF absorber that terminates unused energy to prevent reflections of that unused energy back through the feed structure of the antenna. These could be used at the top of RF array 1606.

Figure 11:
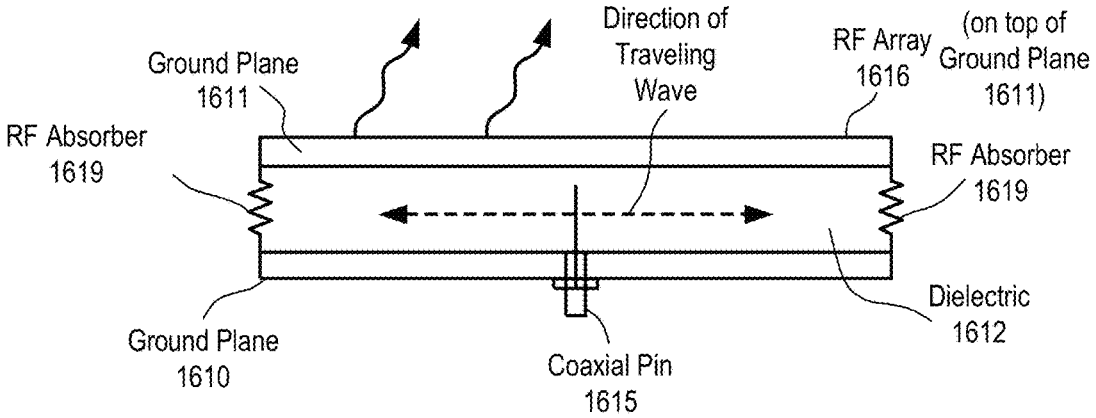
FIG. 11 illustrates another embodiment of the antenna system with an outgoing wave.

FIG. 11 illustrates another embodiment of the antenna system with an outgoing wave. Referring to FIG. 11, two ground planes 1610 and 1611 are substantially parallel to each other with a dielectric layer 1612 (e.g., a plastic layer, etc.) in between ground planes. RF absorbers 1619 (e.g., resistors) couple the two ground planes 1610 and 1611 together. A coaxial pin 1615 (e.g., 50Ω) feeds the antenna. An RF array 1616 is on top of dielectric layer 1612 and ground plane 1611.

In operation, a feed wave is fed through coaxial pin 1615 and travels concentrically outward and interacts with the elements of RF array 1616.

The cylindrical feed in both the antennas of FIGS. 10 and 11 improves the service angle of the antenna. Instead of a service angle of plus or minus forty-five degrees azimuth (±45° Az) and plus or minus twenty-five degrees elevation (±25° El), in one embodiment, the antenna system has a service angle of seventy-five degrees (75°) from the bore sight in all directions. As with any beam forming antenna comprised of many individual radiators, the overall antenna gain is dependent on the gain of the constituent elements, which themselves are angle-dependent. When using common radiating elements, the overall antenna gain typically decreases as the beam is pointed further off bore sight. At 75 degrees off bore sight, significant gain degradation of about 6 dB is expected.

Embodiments of the antenna having a cylindrical feed solve one or more problems. These include dramatically simplifying the feed structure compared to antennas fed with a corporate divider network and therefore reducing total required antenna and antenna feed volume; decreasing sensitivity to manufacturing and control errors by maintaining high beam performance with coarser controls (extending all the way to simple binary control); giving a more advantageous side lobe pattern compared to rectilinear feeds because the cylindrically oriented feed waves result in spatially diverse side lobes in the far field; and allowing polarization to be dynamic, including allowing left-hand circular, right-hand circular, and linear polarizations, while not requiring a polarizer.

Array of Wave Scattering Elements

RF array 1606 of FIG. 10 and RF array 1616 of FIG. 11 include a wave scattering subsystem that includes a group of patch antennas (i.e., scatterers) that act as radiators. This group of patch antennas comprises an array of scattering metamaterial elements (e.g., metamaterial surface scattering antenna elements).

In one embodiment, each scattering element in the antenna system is part of a unit cell that consists of a lower conductor, a dielectric substrate and an upper conductor that embeds a complementary electric inductive-capacitive resonator ("complementary electric LC" or "CELL") that is etched in or deposited onto the upper conductor.

In one embodiment, a liquid crystal (LC) is injected in the gap around the scattering element. Liquid crystal is encapsulated in each unit cell and separates the lower conductor associated with a slot from an upper conductor associated with its patch. Liquid crystal has a permittivity that is a function of the orientation of the molecules comprising the liquid crystal, and the orientation of the molecules (and thus the permittivity) can be controlled by adjusting the bias voltage across the liquid crystal. Using this property, the liquid crystal acts as an on/off switch for the transmission of energy from the guided wave to the CELC. When switched on, the CELC emits an electromagnetic wave like an electrically small dipole antenna.

Controlling the thickness of the LC increases the beam switching speed. A fifty percent (50%) reduction in the gap between the lower and the upper conductor (the thickness of the liquid crystal) results in a fourfold increase in speed. In another embodiment, the thickness of the liquid crystal results in a beam switching speed of approximately fourteen milliseconds (14 ms). In one embodiment, the LC is doped in a manner well-known in the art to improve responsiveness so that a seven millisecond (7 ms) requirement can be met.

The CELC element is responsive to a magnetic field that is applied parallel to the plane of the CELC element and perpendicular to the CELC gap complement. When a voltage is applied to the liquid crystal in the metamaterial scattering unit cell, the magnetic field component of the guided wave induces a magnetic excitation of the CELC, which, in turn, produces an electromagnetic wave in the same frequency as the guided wave.

The phase of the electromagnetic wave generated by a single CELC can be selected by the position of the CELC on the vector of the guided wave. Each cell generates a wave in phase with the guided wave parallel to the CELC. Because the CELCs are smaller than the wave length, the output wave has the same phase as the phase of the guided wave as it passes beneath the CELC.

In one embodiment, the cylindrical feed geometry of this antenna system allows the CELC elements to be positioned at forty-five-degree (45°) angles to the vector of the wave in the wave feed. This position of the elements enables control of the polarization of the free space wave generated from or received by the elements. In one embodiment, the CELCs are arranged with an inter-element spacing that is less than a free-space wavelength of the operating frequency of the antenna. For example, if there are four scattering elements per wavelength, the elements in the 30 GHz transmit antenna will be approximately 2.5 mm (i.e., ¼th the 10 mm free-space wavelength of 30 GHz).

In one embodiment, the CELCs are implemented with patch antennas that include a patch co-located over a slot with liquid crystal between the two. In this respect, the metamaterial antenna acts like a slotted (scattering) wave guide. With a slotted wave guide, the phase of the output wave depends on the location of the slot in relation to the guided wave.

Cell Placement

Figure 12:
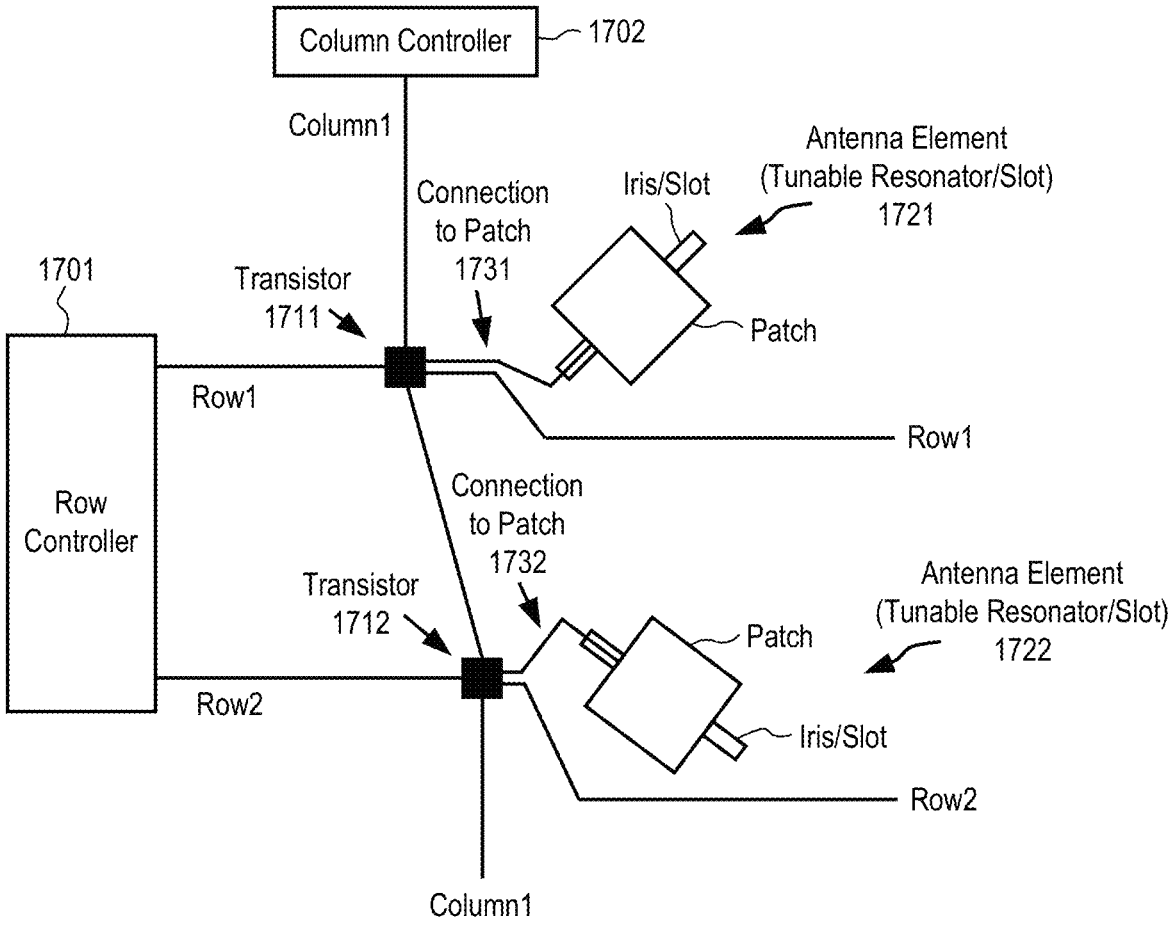
FIG. 12 illustrates one embodiment of the placement of matrix drive circuitry with respect to antenna elements.

In one embodiment, the antenna elements are placed on the cylindrical feed antenna aperture in a way that allows for a systematic matrix drive circuit. The placement of the cells includes placement of the transistors for the matrix drive. FIG. 12 illustrates one embodiment of the placement of matrix drive circuitry with respect to antenna elements. Referring to FIG. 12, row controller 1701 is coupled to transistors 1711 and 1712, via row select signals Row1 and Row2, respectively, and column controller 1702 is coupled to transistors 1711 and 1712 via column select signal Column1. Transistor 1711 is also coupled to antenna element 1721 via connection to patch 1731, while transistor 1712 is coupled to antenna element 1722 via connection to patch 1732.

In an initial approach to realize matrix drive circuitry on the cylindrical feed antenna with unit cells placed in a non-regular grid, two steps are performed. In the first step, the cells are placed on concentric rings and each of the cells is connected to a transistor that is placed beside the cell and acts as a switch to drive each cell separately. In the second step, the matrix drive circuitry is built in order to connect every transistor with a unique address as the matrix drive approach requires. Because the matrix drive circuit is built by row and column traces (similar to LCDs) but the cells are placed on rings, there is no systematic way to assign a unique address to each transistor. This mapping problem results in very complex circuitry to cover all the transistors and leads to a significant increase in the number of physical traces to accomplish the routing. Because of the high density of cells, those traces disturb the RF performance of the antenna due to coupling effect. Also, due to the complexity of traces and high packing density, the routing of the traces cannot be accomplished by commercially available layout tools.

In one embodiment, the matrix drive circuitry is predefined before the cells and transistors are placed. This ensures a minimum number of traces that are necessary to drive all the cells, each with a unique address. This strategy reduces the complexity of the drive circuitry and simplifies the routing, which subsequently improves the RF performance of the antenna.

More specifically, in one approach, in the first step, the cells are placed on a regular rectangular grid composed of rows and columns that describe the unique address of each cell. In the second step, the cells are grouped and transformed to concentric circles while maintaining their address and connection to the rows and columns as defined in the first step. A goal of this transformation is not only to put the cells on rings but also to keep the distance between cells and the distance between rings constant over the entire aperture. In order to accomplish this goal, there are several ways to group the cells.

Figure 13:
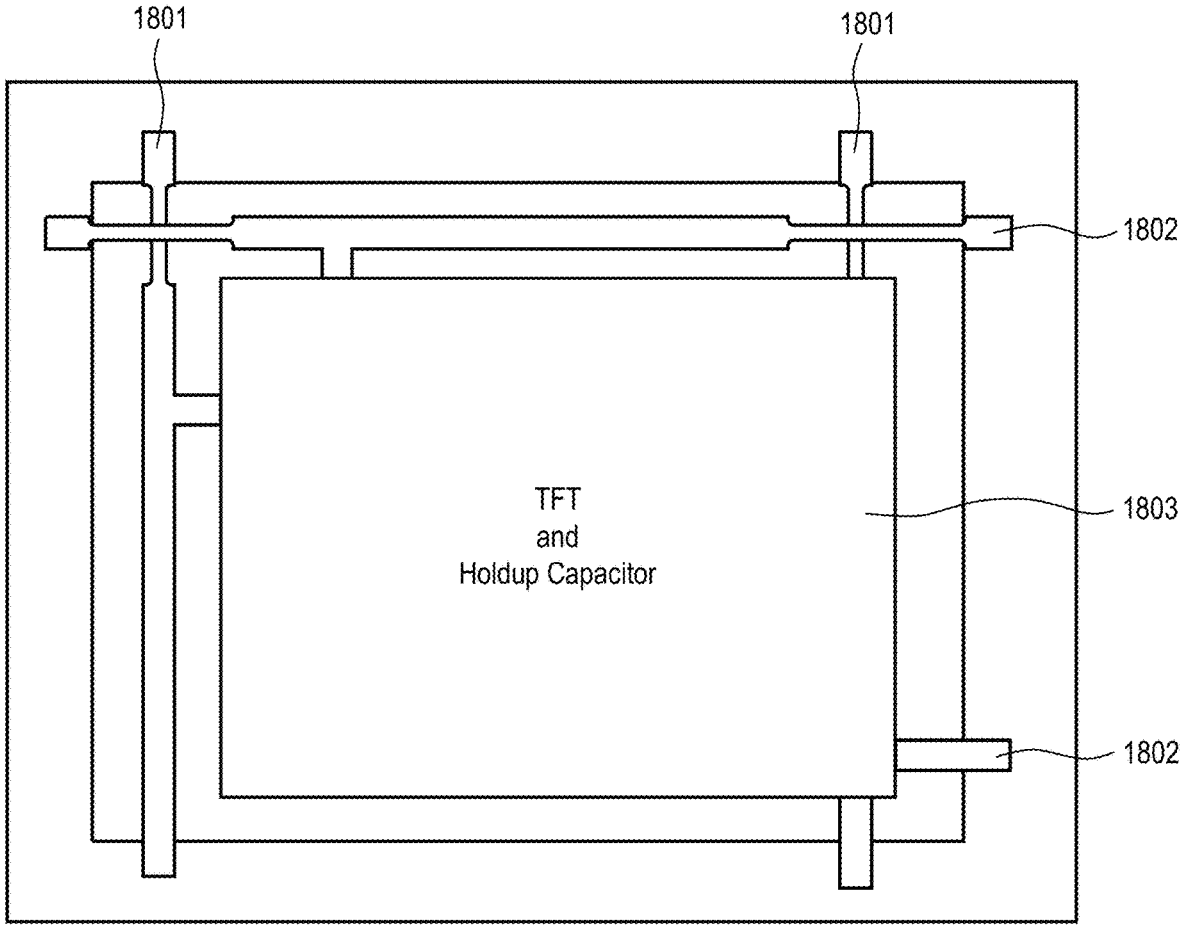
FIG. 13 illustrates one embodiment of a TFT package.

In one embodiment, a TFT package is used to enable placement and unique addressing in the matrix drive. FIG. 13 illustrates one embodiment of a TFT package. Referring to FIG. 13, a TFT and a hold capacitor 1803 is shown with input and output ports. There are two input ports connected to traces 1801 and two output ports connected to traces 1802 to connect the TFTs together using the rows and columns. In one embodiment, the row and column traces cross in 90° angles to reduce, and potentially minimize, the coupling between the row and column traces. In one embodiment, the row and column traces are on different layers.

An Example of a Full Duplex Communication System

Figure 14:
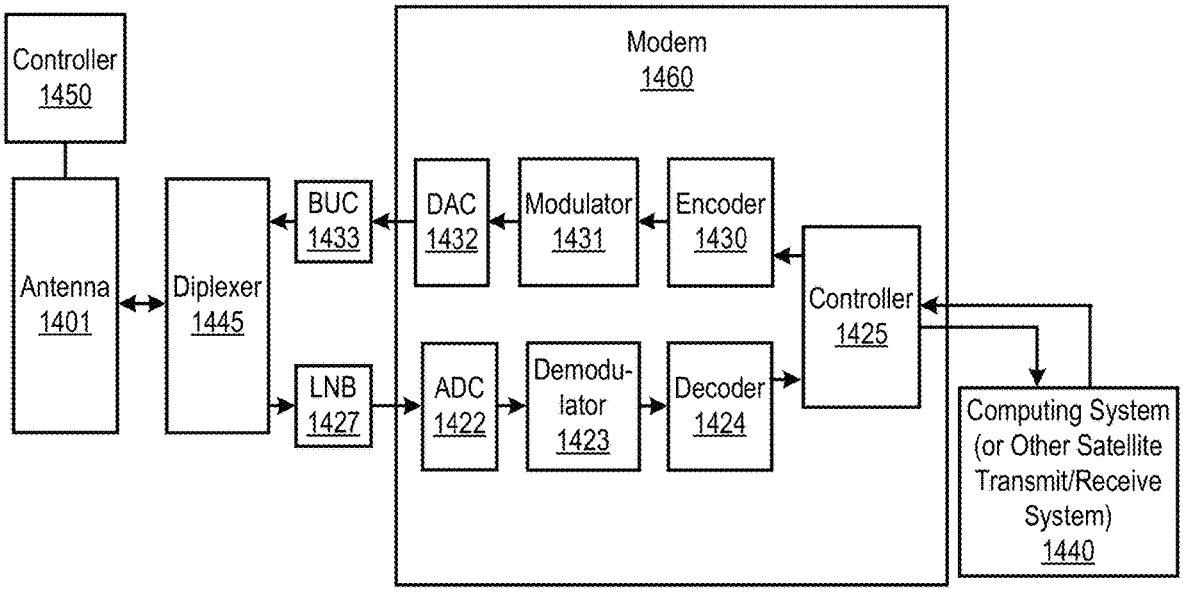
FIG. 14 is a block diagram of one embodiment of a communication system that has simultaneous transmit and receive paths.

In another embodiment, the combined antenna apertures are used in a full duplex communication system. FIG. 14 is a block diagram of an embodiment of a communication system having simultaneous transmit and receive paths. While only one transmit path and one receive path are shown, the communication system may include more than one transmit path and/or more than one receive path.

Referring to FIG. 14, antenna 1401 includes two spatially interleaved antenna arrays operable independently to transmit and receive simultaneously at different frequencies as described above. In one embodiment, antenna 1401 is coupled to diplexer 1445. The coupling may be by one or more feeding networks. In one embodiment, in the case of a radial feed antenna, diplexer 1445 combines the two signals and the connection between antenna 1401 and diplexer 1445 is a single broad-band feeding network that can carry both frequencies.

Diplexer 1445 is coupled to a low noise block down converter (LNBs) 1427, which performs a noise filtering function and a down conversion and amplification function in a manner well-known in the art. In one embodiment, LNB 1427 is in an out-door unit (ODU). In another embodiment, LNB 1427 is integrated into the antenna apparatus. LNB 1427 is coupled to a modem 1460, which is coupled to computing system 1440 (e.g., a computer system, modem, etc.).

Modem 1460 includes an analog-to-digital converter (ADC) 1422, which is coupled to LNB 1427, to convert the received signal output from diplexer 1445 into digital format. Once converted to digital format, the signal is demodulated by demodulator 1423 and decoded by decoder 1424 to obtain the encoded data on the received wave. The decoded data is then sent to controller 1425, which sends it to computing system 1440.

Modem 1460 also includes an encoder 1430 that encodes data to be transmitted from computing system 1440. The encoded data is modulated by modulator 1431 and then converted to analog by digital-to-analog converter (DAC) 1432. The analog signal is then filtered by a BUC (up-convert and high pass amplifier) 1433 and provided to one port of diplexer 1445. In one embodiment, BUC 1433 is in an out-door unit (ODU).

Diplexer 1445 operating in a manner well-known in the art provides the transmit signal to antenna 1401 for transmission.

Controller 1450 controls antenna 1401, including the two arrays of antenna elements on the single combined physical aperture.

The communication system would be modified to include the combiner/arbiter described above. In such a case, the combiner/arbiter after the modem but before the BUC and LNB.

Note that the full duplex communication system shown in FIG. 14 has a number of applications, including but not limited to, internet communication, vehicle communication (including software updating), etc.

There is a number of example embodiments described herein.

Example 1 is a portable satellite antenna apparatus comprising a flat panel antenna and a container to house the antenna, the container having at least one radio-frequency (RF) transparent material through which the antenna is operable to transmit and receive satellite communications.

Example 2 is the antenna apparatus of example 1 that may optionally include that the at least one RF transparent material comprises a lid of the container.

Example 3 is the antenna apparatus of example 2 that may optionally include that the lid is operable as a radome of the antenna.

Example 4 is the antenna apparatus of example 1 that may optionally include that the at least one RF transparent material comprises plastic or fiberglass.

Example 5 is the antenna apparatus of example 1 that may optionally include that the at least one RF transparent material is tuned to frequencies at which the antenna is designed to operate.

Example 6 is the antenna apparatus of example 1 that may optionally include that the at least one RF transparent material has a convex shape with respect to a surface of the antenna through which the antenna transmits and receives the satellite communications.

Example 7 is the antenna apparatus of example 1 that may optionally include that an externally exposed portion of the at least one RF transparent material has a hydrophobic coating.

Example 8 is the antenna apparatus of example 1 that may optionally include that the antenna is operable to transmit and receive satellite communications through the at least one RF transparent material during closed-container operation when the container is closed.

Example 9 is a portable satellite antenna apparatus comprising a flat panel antenna and a container to house the antenna, the container having at least one RF transparent lid through which the antenna is operable to transmit and receive satellite communications, wherein the lid comprises a material that is a predetermined distance from the antenna surface and tuned to frequencies at which the antenna is designed to operate, wherein the antenna is operable to transmit and receive satellite communications through the at least one RF transparent lid for closed-container operation when the container is closed.

Example 10 is the antenna apparatus of example 9 that may optionally include that the lid is operable as a radome of the antenna.

Example 11 is the antenna apparatus of example 9 that may optionally include that the at least one RF transparent material comprises plastic or fiberglass.

Example 12 is the antenna apparatus of example 9 that may optionally include that the at least one RF transparent material has a convex shape with respect to a surface of the antenna through which the antenna transmits and receives the satellite communications.

Example 13 is the antenna apparatus of example 9 that may optionally include that an externally exposed portion of the at least one RF transparent material has a hydrophobic coating.

Example 14 is the antenna apparatus of example 9 that may optionally include that the material has a thickness that provides a protective shell and structure support for the container as a transit case while not impeding RF transmission.

Example 15 is the antenna apparatus of example 9 that may optionally includea rapidly deployable and self-contained network system.

Some portions of the detailed descriptions above are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The present invention also relates to apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, such as, but is not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions, and each coupled to a computer system bus.

The algorithms and displays presented herein are not inherently related to any particular computer or other apparatus. Various general-purpose systems may be used with programs in accordance with the teachings herein, or it may prove convenient to construct more specialized apparatus to perform the required method steps. The required structure for a variety of these systems will appear from the description below. In addition, the present invention is not described with reference to any particular programming language. It will be appreciated that a variety of programming languages may be used to implement the teachings of the invention as described herein.

A machine-readable medium includes any mechanism for storing or transmitting information in a form readable by a machine (e.g., a computer). For example, a machine-readable medium includes read only memory ("ROM"); random access memory ("RAM"); magnetic disk storage media; optical storage media; flash memory devices; etc.

Whereas many alterations and modifications of the present invention will no doubt become apparent to a person of ordinary skill in the art after having read the foregoing description, it is to be understood that any particular embodiment shown and described by way of illustration is in no way intended to be considered limiting. Therefore, references to details of various embodiments are not intended to limit the scope of the claims which in themselves recite only those features regarded as essential to the invention.

We claim:

1. A portable satellite antenna apparatus comprising:

a flat panel antenna having a top side through which the antenna is operable to transmit and receive satellite communications; and a container to house the antenna, the container having a moveable lid comprising at least one radio-frequency (RF) transparent material through which the antenna is operable to transmit and receive satellite communications through the lid during closed-container operation when the container is closed or without going through the lid during open-container operation when the lid is removed from over the top side of the antenna.

2. The apparatus defined in claim 1 wherein the flat panel antenna comprises a radome, wherein the radome and the lid of the container have a separation from each other when in the closed-container operation.

3. The apparatus defined in claim 1 wherein the at least one RF transparent material comprises plastic or fiberglass.

4. The apparatus defined in claim 1 wherein the at least one RF transparent material is tuned to frequencies at which the antenna is designed to operate.

5. The apparatus defined in claim 1 wherein the at least one RF transparent material has a convex shape with respect to a surface of the antenna through which the antenna transmits and receives the satellite communications.

6. The apparatus defined in claim 1 wherein an externally exposed portion of the at least one RF transparent material has a hydrophobic coating.

7. The apparatus defined in claim 1 wherein the antenna is operable to transmit and receive satellite communications through the at least one RF transparent material during closed-container operation when the container is closed.

8. A portable satellite antenna apparatus comprising:

a flat panel antenna having a top side through which the antenna is operable to transmit and receive satellite communications; and a container to house the antenna, the container having at least one RF transparent moveable lid through which the antenna is operable to transmit and receive satellite communications, wherein the lid comprises a material that is a predetermined distance from the antenna surface and tuned to frequencies at which the antenna is designed to operate, wherein the antenna is operable to transmit and receive satellite communications through the at least one RF transparent lid for closed-container operation when the container is closed or without going through the lid during open-container operation when the lid is removed from over the top side of the antenna, wherein the predetermined distance is such that reflections caused by the lid do not destructively interact with fields in the antenna.

9. The apparatus defined in claim 2 wherein the separation is such that reflections caused by the lid do not destructively interact with fields in the antenna.

10. The apparatus defined in claim 1 wherein the flat panel antenna comprises a radome, wherein the radome and the lid are separated by the predetermined distance.

11. The apparatus defined in claim 8 wherein the at least one RF transparent material comprises plastic or fiberglass.

12. The apparatus defined in claim 8 wherein the at least one RF transparent material has a convex shape with respect to a surface of the antenna through which the antenna transmits and receives the satellite communications.

13. The apparatus defined in claim 8 wherein an externally exposed portion of the at least one RF transparent material has a hydrophobic coating.

14. The apparatus defined in claim 8 wherein the material has a thickness that provides a protective shell and structure support for the container as a transit case while not impeding RF transmission.

15. The apparatus defined in claim 8 further comprising rapidly deployable and self-contained network system.

* * * * *